United States Patent [19]

Inglis

[11] 4,240,261

[45] Dec. 23, 1980

[54] TEMPERATURE-ADJUSTABLE VORTEX TUBE ASSEMBLY

[75] Inventor: Leslie R. Inglis, Cincinnati, Ohio

[73] Assignee: Vortec Corporation, Cincinnati, Ohio

[21] Appl. No.: 65,093

[22] Filed: Aug. 9, 1979

[51] Int. Cl.[3] ..... F25B 9/02

[52] U.S. Cl. ..... 62/5

[58] Field of Search ..... 62/5

[56] References Cited

U.S. PATENT DOCUMENTS

| | | | |
|---|---|---|---|
| 1,952,281 | 3/1934 | Ranque | 62/170 |
| 2,819,590 | 1/1958 | Green | 62/5 |
| 3,173,273 | 3/1965 | Fulton | 62/5 |
| 3,208,229 | 9/1965 | Fulton | 62/5 |
| 3,461,676 | 8/1969 | Toelke et al. | 62/5 |
| 3,786,643 | 1/1974 | Anderson et al. | 62/5 |

FOREIGN PATENT DOCUMENTS

| | | | |
|---|---|---|---|
| 489917 | 2/1976 | U.S.S.R. | 62/5 |

*Primary Examiner*—Lloyd L. King

*Attorney, Agent, or Firm*—Tilton, Fallon, Lungmus & Chestnut

[57] ABSTRACT

A vortex tube assembly equipped with a control mechanism for use in selectively adjusting the temperature of air discharged from the primary outlet of the assembly to any temperature within the range from maximum hot to maximum cold, the temperature of the discharged air varying in generally linear relation with adjustments in the position of a temperature control handle. Ideally, the temperature of the discharged air may thus be varied without significantly altering the rate of flow through the primary outlet. The assembly includes a vortex tube disposed within a cylindrical housing having primary and secondary outlets, and a pair of flow-dividing members within the housing, at least one of which is movably mounted, for controlling the temperature of the air discharged from the primary outlet by altering the proportions of hot and cold air flowing through the passages of such members.

14 Claims, 8 Drawing Figures

TEMPERATURE-ADJUSTABLE VORTEX TUBE ASSEMBLY

BACKGROUND

Counterflow vortex tubes and their method of operation are well known, such tubes being described, for example, in Fulton U.S. Pat. Nos. 3,173,273 and 3,208,229, and Ranque U.S. Pat. No. 1,952,281. Compressed air (or other gas) from any suitable source enters such a tube and is throttled through nozzles to produce the special temperature change effects which are the unique characteristics of a vortex tube. The result is that the compressed air entering the tube is divided into hot and cold fractions from outlets at opposite ends of the tube. Usually a vortex tube is used for the cold air produced with typical temperatures at the cold air outlet ranging from minus 40° F. to plus 30° F. The air fraction discharged from the hot end is commonly exhausted to atmosphere.

In some applications, such as where a vortex tube is used for cooling the wearer of a protective suit, or a suit (or helmet) worn in a sandblasting operation or in some other industrial operation, some control over the extent of cooling is required to meet the needs or preferences of the wearer. Quite commonly, such control is achieved by providing a valve at the tube's hot end which may be manually adjusted to regulate the proportion of air discharged from the respective ends. Since the temperature reduction of the air discharged from the cold end of the vortex tube varies indirectly with the amount of air flowing therefrom, an adjustment which causes a greater proportion of the compressed air to escape from the cold end (and a lesser proportion from the hot end) would also result in an elevation of the temperature of air from the cold end. However, the reduction in the cooling effect resulting from an increase in the air temperature discharged from the tube's cold end may be offset at least partly by the increased volume of air flowing from the cold end. A user desiring to reduce the cooling effect and adjusting the vortex tube in order to increase the temperature of the air discharged from the tube's cold end might, because of such increased flow, sense that even further adjustment is necessary. Because manual adjustments produce changes in flow as well as temperature, a user may encounter considerable difficulty in selecting a condition of adjustment which provides just the right amount of cooling.

SUMMARY

One aspect of this invention lies in recognizing the aforementioned disadvantage or defect of prior constructions, and, in particular, in recognizing the need for a vortex tube assembly equipped with a control which may be shifted into any selected position along its range of movement to produce corresponding or "sensible" changes in the temperature of the air discharged from the primary outlet of the assembly.

Another object is to provide a vortex tube assembly having an operating handle which may be shifted in any selected position of adjustment to control the temperature of the air discharged from the primary outlet without at the same time substantially altering the rate of flow from that outlet. A still further object is to provide a compact and highly effective assembly equipped with a single operating handle which may be readily adjusted to vary the temperature of the air discharged from the primary outlet over a temperature range extending from maximum hot to maximum cold.

A still further object is to provide a "sensible" control for regulating the temperature of air discharged from a vortex tube; that is, a control which may be shifted into settings anywhere from one extreme position to the other to produce corresponding changes in discharge temperature bearing a generally linear relation with respect to the settings of the control handle.

Briefly, the assembly comprises a basic vortex tube mounted within a housing having a primary outlet and a secondary outlet. A pair of flow-dividing members are disposed within the chamber of the housing, one of the members being movable with respect to the other to regulate the proportions of cold and hot air passing into the respective outlets.

More specifically, a first flow-dividing member is disposed within the chamber of the housing and is provided with a hot air passage receiving air from the hot end of the vortex tube and a cold air passage receiving air from the tube's cold end. A second flow-dividing member is disposed immediately adjacent the first and is provided with a pair of flow passages extending therethrough. One of such flow passages of the second flow-dividing member is in continuous communication with the primary outlet of the housing whereas the other flow passage remains in communication with the secondary outlet. The members are positioned and arranged so that the two flow passages of the second member receive substantially all of the air passing from the hot and cold air passages of the first member, the relative positions of the two members determining the proportions of hot and cold air which each flow passage of the second member receives from the passages of the first member.

In the embodiment illustrated and described, the two members are generally cylindrical and are coaxial with respect to each other and to the vortex tube itself. The first flow-dividing member is provided with an axial recess which rotatably receives an end portion of one outlet tube, preferably the hot air tube, of the vortex tube. The second flow-dividing member is fixed within the housing with opposing end surfaces of the two members in slidable sealing engagement with each other. By rotating the first member relative to the second member so that the flow passage of the latter which communicates with the primary outlet of the assembly receives varying amounts of air from the hot and cold passages of the first member, the temperature of the air discharged from the primary outlet may be varied without significantly altering the volume of air flowing through that outlet.

Other features, objects, and advantages of the invention will become apparent from the drawings and specification.

DRAWINGS

DETAILED DESCRIPTION

Figure 1:
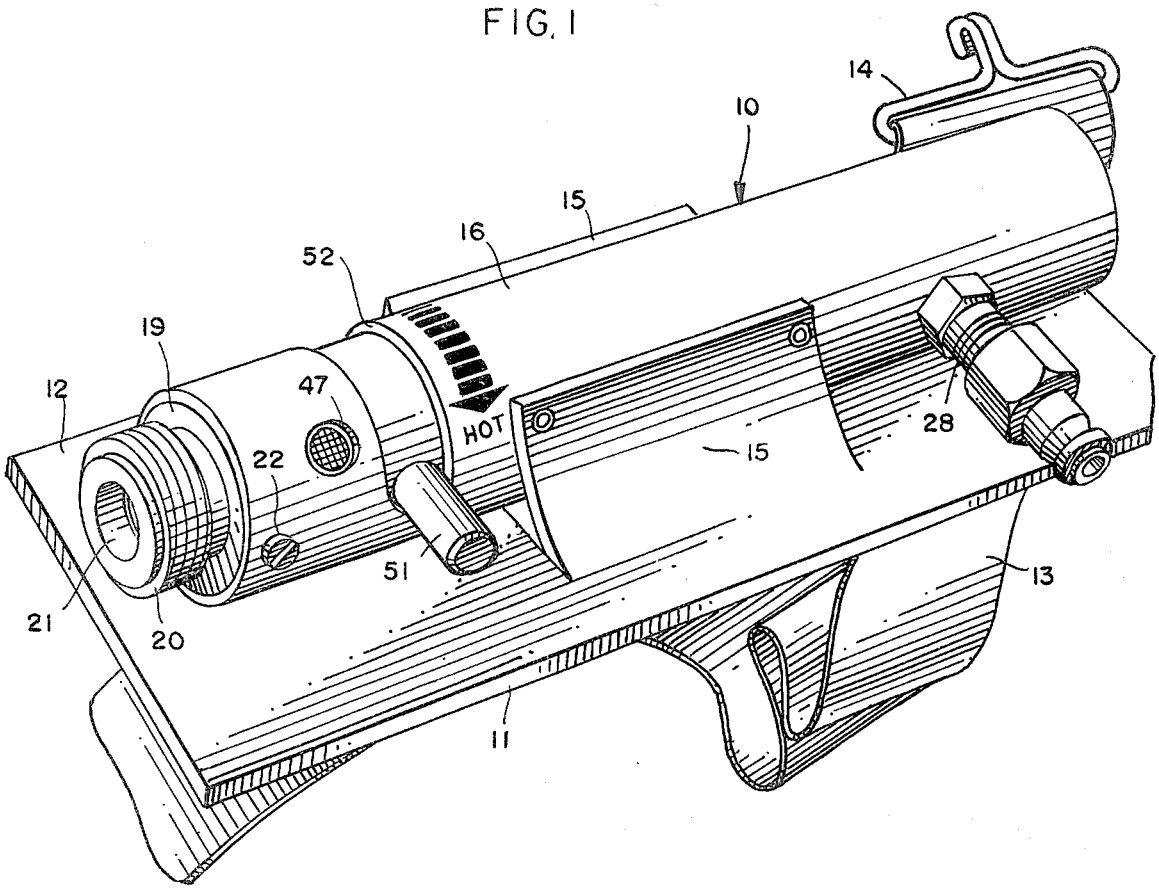
FIG. 1 is a perspective view of a vortex tube assembly embodying the invention, the assembly being equipped with a holder to facilitate the wearing of the device by a user.

Referring to the drawings, FIG. 1 illustrates a vortex tube assembly 10 mounted upon a suitable holder 11 which, in the embodiment illustrated, takes the form of a rectangular piece of leather 12 or other flexible material to which a belt or carrying strap 13 is suitably mounted. Fasteners provided by the belt, one of which is indicated at 14, permit the device to be worn by a user. Flaps or tabs 15 may be partially cut from the leather piece and riveted or otherwise secured to the casing 16 of the vortex tube assembly.

Figure 2:
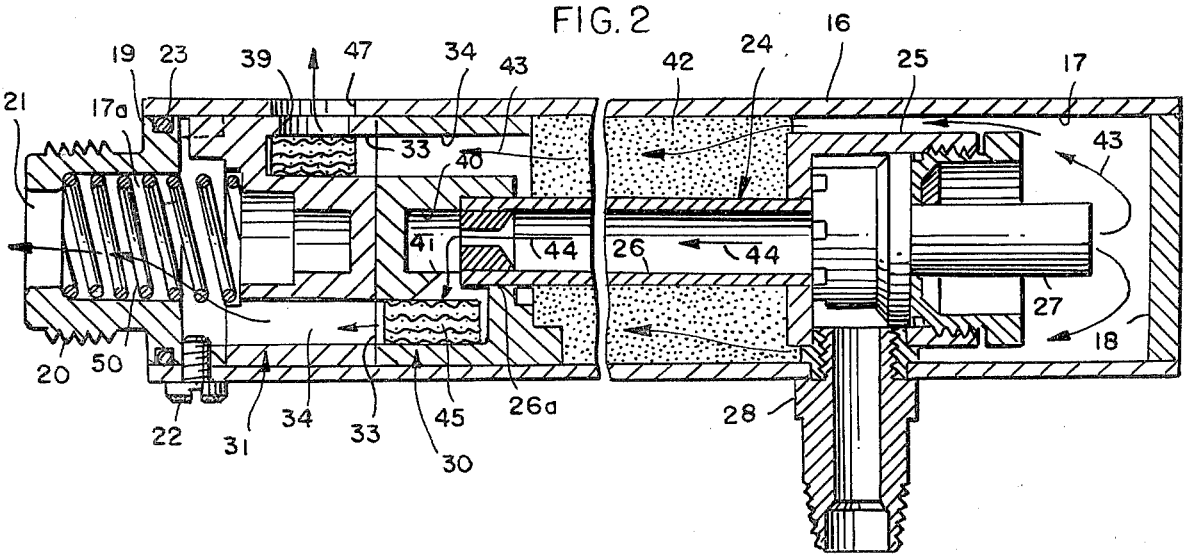
FIG. 2 is a broken and somewhat schematic longitudinal sectional view of the assembly.

The casing or housing 16 is generally cylindrical in shape and defines a chamber 17 therein (FIG. 2). One end of the casing is closed by end wall 18; the opposite end is provided with an apertured end wall 19 having a neck portion 20 which defines the primary outlet 21 for the assembly. The neck portion may be externally threaded, or may be provided with any other suitable projections or formations, for facilitating the attachment and detachment of a hose adapted to carry air to a wearer's suit or helmet, or to any other article or device requiring cooling. In the illustrated embodiment, end wall 19 is removably mounted within the tubular shell of the casing, being secured therein by screw 22. Leakage of pressurized air is prevented by resilient sealing ring 23.

A conventional vortex tube 24 is mounted within casing 16. Vortex tube 24 is similar to the vortex tubes disclosed in the aforementioned patents, having a cylindrical generator body 25, a tubular hot air outlet 26 coaxial with the body and projecting from one end thereof, and a tubular cold air outlet 27 also coaxial with the body and projecting from the opposite end thereof. As shown in FIG. 2, the vortex tube is coaxial with the cylindrical casing 16 with the tubular hot air outlet facing towards the primary outlet 21 and the tubular cold air outlet facing towards, but spaced from, end wall 18. If desired, however, the position of the vortex tube may be reversed with the hot air outlet tube 26 facing end wall 18.

A laterally-projecting inlet fitting 28 communicates with the generator body 25 of the vortex tube 24, the fitting being threadedly secured to both the casing and the generator body as indicated in FIG. 2. Fitting 28 is adapted to be connected to a source of pressurized gas and, more particularly, to a line or hose extending to a compressor or other source of pressurized air. For most applications, the pressure of the air supplied to the vortex tube through fitting 28 will fall within the range of about 80 to 120 psig.

Reference may be had to the aforementioned patents for details concerning the structure and operation of vortex tube 24. For purposes of fully disclosing the present invention, it is believed sufficient to state that the vortex tube 24 operates to divide a stream of compressed air (or other gas) entering the body of the tube through inlet 28 into hot and cold fractions, the hot fraction being discharged axially from the free end of outlet tube 26 and the cold fraction being discharged from the free end of outlet tube 27. By controlling the relative dimensions of the parts, the proportions of the respective fractions, and the maximum/minimum temperatures of those fractions, may be established as desired. Preferably, vortex tube 24 should be constructed so that the rate of discharge from the hot and cold ends is approximately equal.

The casing contains a pair of flow-dividing members 30 and 31 for controlling the temperature of the air discharged from primary outlet 21. As shown most clearly in FIGS. 3 and 4, each member is generally cylindrical in configuration. Except for certain modifications described hereinafter, the two members are essentially the same in construction and, if desired, may be formed in the same mold with certain distinctive changes or additions made thereafter in each of them.

Figure 3:
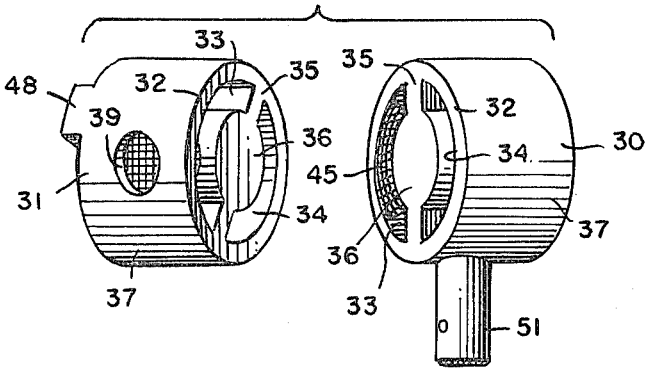
FIG. 3 is an exploded perspective view of the flow-dividing members of the assembly.

Each member 30, 31 has a planar end face 32 which extends along a plane normal to the axis of the member and which is adapted to make sealing contact with the same end face of the other member when the members are reversely oriented as indicated in FIGS. 2 and 3. In the illustration given, each of the flow-dividing members has a pair of passages 33 and 34 extending axially inwardly from end face 32 and divided by a generally diametrically oriented septum 35. Referring to FIG. 3, it will be seen that the septum 35 radiates outwardly from a central hub portion 36 and merges with an annular outer wall 37, with the result that each of the passages 33 and 34 is of arcuate configuration.

Figure 4:
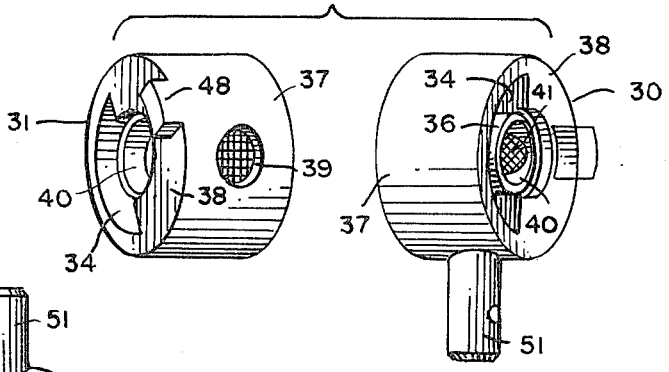
FIG. 4 is similar to FIG. 3 but illustrates other portions of the flow-dividing members.

Only one of the arcuate passages 34 extends completely through each member, opening through the opposite end face 38 thereof (FIG. 4). The other arcuate passage 33, in the case of member 31, opens laterally outwardly through opening 39 in side wall 37 and, in the case of member 30, opens laterally inwardly into the recess 40 of hub 36 through opening 41 (FIGS. 2 and 4). As indicated in FIG. 2, the central recess 40 in hub 36 of member 30 snugly but rotatably receives the end portion 26*a* of outlet tube 26 of the vortex tube 24. Consequently, the arcuate passage 33 of member 30 is in direct flow communication with outlet tube 26 and, since that tube constitutes the hot air outlet for the vortex tube, the arcuate flow passage 33 of member 30 functions as a hot air passage. Conversely, the other arcuate passage 34 of member 30 serves as a cold air passage since it communicates with outlet 27 of the vortex tube through the interior of the casing external to the vortex tube (FIG. 2).

More specifically, referring to FIG. 2, it will be observed that the free end of the cold air outlet 27 of the vortex tube is spaced from end wall 18 of the casing, the end wall serving as a deflector to reverse the direction of flow of cold air discharged from the vortex tube. Since the outside dimensions of generator body 25 are smaller than the inside cross sectional dimensions of the casing, cold air deflected by end wall 18 is directed towards the opposite end of the casing through filter 42 and into the arcuate cold air flow passage 33 of flow-dividing member 30. Such reversed direction of flow is indicated by arrows 43 in FIG. 2.

Hot air from the vortex tube's hot air outlet 26 follows the direction of flow indicated by arrows 44 in FIG. 2. After leaving the outlet of the vortex tube, such hot air flows into axial recess 40 of member 30, then laterally through port or opening 41 and into arcuate hot air flow passage 33 of member 30.

If desired, a suitable noise muffling element, such as fine-mesh folded screening 45, may be mounted within the arcuate passage 33 of member 30. The screening not only provides a noise muffling function but also distributes the hot air more evenly through arcuate passage 33.

Member 42 also performs sound-suppressing functions, and can be formed of open-celled foam, folded screening or open-mesh fabric, or any other suitable porous material. Open-celled foam such as polyurethane foam has been found particularly effective.

As already stated, member 31 is reversely oriented with respect to member 30. Air flowing into passage 34 of member 31 may continue completely through member 31 into the chamber portion 17*a* of the casing, exiting from that chamber portion through the primary outlet 21. Gas entering the other arcuate passage of the member 31 exits laterally outwardly through aligned openings 39 and 47 in the member 31 and casing 16, respectively. A projection 48 from end 38 of member 31 is received within a recess provided by end wall 19 of the casing, thus keying or locking the two parts together and, since the end wall is fixed by screw 22 against rotation with respect to the casing, member 31 is effectively held against rotation within casing chamber 17. Thus, the opening 39 in the side wall of member 31 is held in alignment with opening 47 of the casing, such lateral opening serving as a secondary outlet for the vortex tube assembly.

A suitable muffling element 49 may be mounted within the arcuate flow passage 33 of flow-dividing member 31, as shown most clearly in FIG. 2. Such element may take the form of folded screening and may be identical to element 45 disposed in flow-dividing member 30.

A helical compression spring 50 is disposed within chamber portion 17*a* of the casing to maintain the two flow-dividing members 30 and 31 in firm engagement with each other (FIG. 2). It will be observed that member 30 is held against axial movement away from spring 50 by the hot air outlet tube 26 of the vortex tube upon which it is journaled, the vortex tube in turn being secured against axial displacement within the chamber by means of compressed air inlet fitting 28. Consequently, the spring not only holds the flow-dividing members with their end faces 32 in sliding and sealing engagement, but also helps to maintain an effective seal between the recess 40 of member 30 and the outlet tube 26 of vortex tube 24.

Although member 31 is fixed against rotation within chamber 17, member 30 may be rotated approximately 180° by means of a handle or lever 51 which projects radially outwardly through semi-circumferential slot 52 in casing 16 (FIG. 1). It is the rotational movement of flow-dividing member 30 relative to flow-dividing member 31 that results in a full range of adjustment of the air discharge temperatures through primary outlet 21 from maximum cold to maximum hot.

Figure 5:
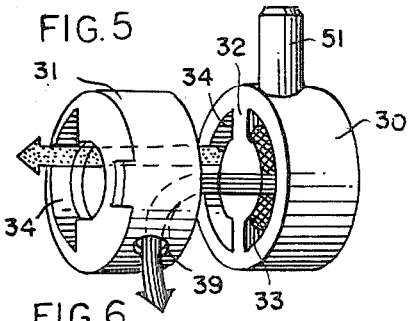
FIG. 5 is an exploded perspective view schematically illustrating the flow-dividing members in one extreme position of adjustment.
Figure 6:
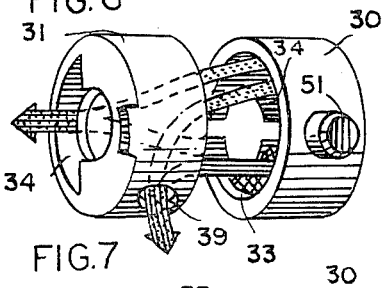
FIG. 6 is a view similar to FIG. 5 but illustrating the members in an intermediate position of adjustment.
Figure 7:
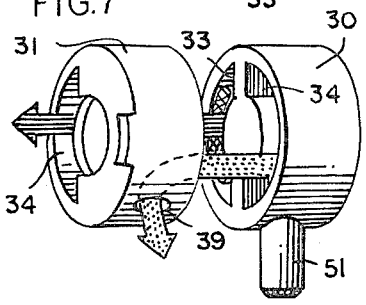
FIG. 7 is similar to FIGS. 5 and 6 but illustrates the members in a second extreme position of adjustment.

The operation is graphically depicted in FIGS. 5 through 7, with only the flow-dividing members 30 and 31 being shown, such members being illustrated in axially-spaced relation for purposes of illustration although it is to be understood that in actual operation their opposing end faces 32 would be held in mutual sliding sealing engagement. Member 31 is fixed against rotation with its arcuate flow passage 34 in continuous communication with primary outlet 21, and with its other arcuate flow passage 33 (not visible in FIGS. 5–7) in continuous communication with the secondary outlet through lateral opening 39.

Although the other flow-dividing member 30 is rotatable, its two flow passages 33 and 34 remain in constant communication with the hot and cold ends of the vortex tube, respectively. Passage 33 of member 30 is always a hot air passage and, conversely, passage 34 of that member is always a cold air passage. By rotating member 30 over its 180° arc of movement, hot air (represented by shaded arrows in FIGS. 5–7) flowing through the hot air passage 33 of member 30 is either directed entirely into arcuate passage 33 of member 31 (from which it is laterally discharged through opening 39, as shown in FIG. 5), or is directed entirely into arcuate passage 34 of member 31 (FIG. 7), or is divided so that some of it flows through each of the passages of member 31, the proportional amounts depending on the rotational position of member 30 (FIG. 6). Similarly, cold air (represented by dotted arrows in FIGS. 5–7) is directed entirely into passage 34 of member 31 (FIG. 5), or entirely into the other arcuate passage and out through lateral opening 39 (FIG. 7), or is divided between the two arcuate passages of member 31 (FIG. 6).

It is believed apparent that the vortex tube assembly may be easily adjusted by means of the single handle lever 51 to vary the air temperature at the primary outlet 21—the outlet which discharges air to be used by the user—to provide any selected temperature over the full range which the vortex tube is capable of generating. Furthermore, the adjustability is "sensible"; that is, incremental variations in the handle position may be relied upon to produce corresponding incremental variations in discharge temperature without significant changes in air flow volume.

Figure 8:
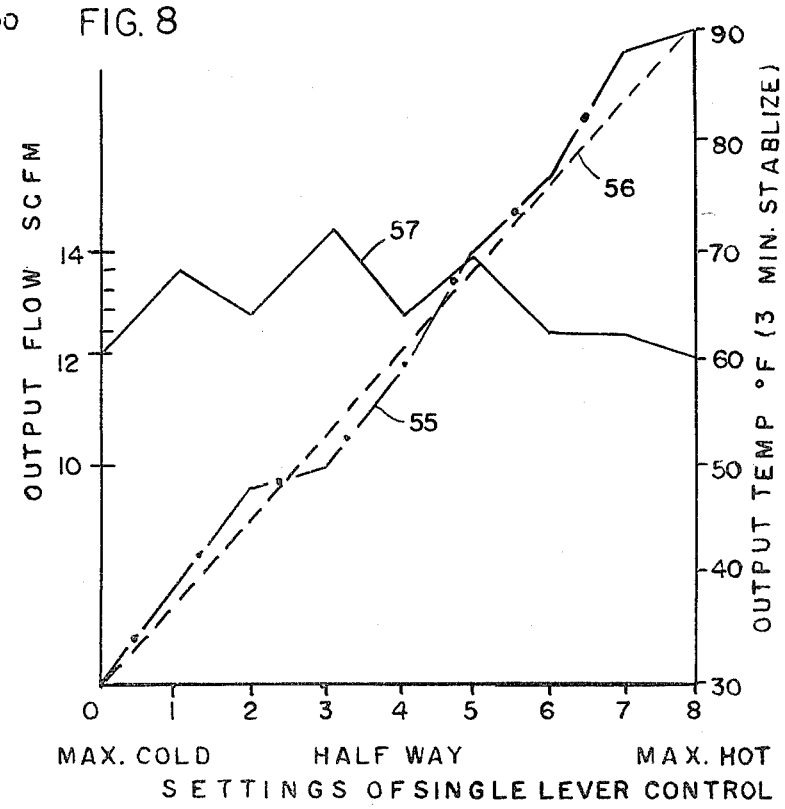
FIG. 8 is a graph indicating certain performance characteristics of one assembly embodying this invention.

FIG. 8 is a graph showing the performance characteristics of a vortex tube assembly operated with air at 100 psig and showing the results at each of nine settings from maximum cold air discharge to maximum hot air discharge. The handle settings were equally spaced so that setting "4" was the mid point between the two extremes. At each setting, the output temperature (the temperature of air discharged from primary outlet 22) was measured after allowing three minutes of operation for purposes of stabilization. Line 55 shows the output temperature at each of the settings from a minimum temperature of 30° F. to a maximum temperature of 90° F. It will be observed that a state of linearity is closely approached with temperature variations falling within 4° F. from a straight line 56.

The output flow from the primary outlet 21 remained relatively constant over the full range of incremental positions, as indicated by line 57. Specifically, line 57 reveals that the output flow in cubic feet per minute for all nine settings was 13.05 SCFM±9%. While results may vary depending on design variations of the vortex tube assembly, it is believed that the results depicted in FIG. 8 are fairly representative and that even better results are possible. For most purposes, particularly for air conditioning flight suits, work suits, helmets, and the like, the performance characteristics represented in FIG. 8, would be highly acceptable. Since such performance is achievable by a device having only a single operating lever which may be readily manipulated by the user, it is believed apparent that this assembly is especially suitable for industrial use.

While in the foregoing I have disclosed an embodiment of the invention in considerable detail for purposes of illustration, it will be understood by those skilled in the art that many of these details may be varied without departing from the spirit and scope of the invention.

I claim:

1. A temperature-adjustable vortex tube assembly comprising a vortex tube having a generator body provided with a compressed air inlet and having coaxial and oppositely-directed tubular outlets for hot and cold air, respectively; a housing defining a chamber receiving said vortex tube; said chamber having a primary outlet and a secondary outlet; a first flow-dividing member disposed within said chamber and provided with a hot air passage and a cold air passage extending therethrough; means directing cold air from said cold air outlet of said vortex tube to said cold air passage of said first flow-dividing member and directing hot air from said hot air outlet of said vortex tube to said hot air passage of said first flow-dividing member; and a second flow-dividing member disposed within said chamber adjacent said first member and provided with a pair of separate passages extending therethrough; one of said passages of said second member communicating with said primary outlet and the other of said passages of said second member communicating with said secondary outlet; said first and second members being positioned and arranged so that air passing through the passages of said first member enter the passages of said second member and being movable relative to each other for selectively varying the proportions of air passing from the respective hot and cold air passages of said first member into each of said passages of said second member, whereby, the temperature of the air discharged from said primary outlet may be controlled by varying the relative positions of said first and second members to alter the proportions of hot and/or cold air flowing through said one passage of said second member and into said primary outlet.

2. The assembly of claim 1 in which said chamber and said first and second flow-dividing members are cylindrical in shape; said hot air passage and said cold air passage terminating at one face of said first flow-dividing member in arcuate and generally diametrically-opposing openings.

3. The assembly of claim 2 in which said passages of said second flow-dividing member terminate at one end face thereof in a pair of arcuate and generally diametrically opposed openings; said one end face of said second flow-dividing member being disposed in slidable sealing engagement with said one end face of said first flow-dividing member; said first and second flow-dividing members being coaxially disposed; one of said flow-dividing members being rotatably mounted within said chamber and the other of said members being fixed within said chamber; and handle means extending from said one member for rotating the same into selected positions of adjustment with respect to said first member.

4. The assembly of claim 3 in which said one flow-dividing member is said first flow-dividing member.

5. The assembly of claim 3 in which said first flow-dividing member has a cylindrical hub portion having an axial recess at one end thereof, said recess constituting a portion of one of said hot and cold air passages of said first flow-dividing member; said recess being cylindrical in configuration and receiving an end portion of one of said tubular outlets of said vortex tube.

6. The assembly of claim 5 in which said recess receives an end portion of said hot air outlet of said vortex tube.

7. The assembly of claim 6 in which said first flow-dividing member is rotatably mounted within said chamber and said recess rotatably receives said end portion of said tubular hot air outlet.

8. The assembly of claim 1 in which said means includes a transverse wall of said housing for reversing the direction of flow of air discharged from one of said outlets of said vortex tube back towards said flow-dividing members.

9. A temperature-adjustable vortex tube assembly comprising a vortex tube having a generator body provided with a compressed air inlet and having coaxial and oppositely-directed tubular outlets for hot and cold air, respectively; a housing defining a generally cylindrical chamber receiving said vortex tube; said chamber having a primary outlet and a secondary outlet; first and second flow-dividing members of cylindrical configuration disposed within said chamber adjacent one tubular outlet of said vortex tube; said housing having an end wall spaced from the other of said tubular outlets of said vortex tube for directing air discharged therefrom in a reverse direction back towards said flow-dividing members; said first flow-dividing member having a pair of passages extending therethrough, one of said passages communicating with said one outlet of said vortex tube and said other passage receiving reversely-directed air discharged from said other outlet of said vortex tube; said second flow-dividing member having a pair of passages extending therethrough, one of said passages communicating with said primary outlet and the other of said passages communicating with said secondary outlet; said cylindrical flow-dividing members having a pair of end faces disposed in slidable sealing engagement with said passages of said flow-dividing members terminating in arcuate openings in said opposing end faces; one of said flow-dividing members being rotatably mounted within said housing for altering the registration of said openings of said passages of said members for varying the proportions of hot and cold air flowing to said primary and secondary outlets of said chamber.

10. The assembly of claim 9 in which said arcuate openings of each flow-dividing member are of substantially the same cross sectional dimensions.

11. The assembly of claim 9 in which spring means are provided for maintaining the end faces of said flow-dividing members in slidable sealing engagement.

12. The assembly of claim 9 in which said first flow-dividing member is rotatably mounted within said housing.

13. The assembly of claim 12 in which said first flow-dividing member is provided with an axial recess rotatably receiving a portion of said one outlet of said vortex tube, said one passage of said first flow-dividing member communicating with said recess.

14. The assembly of claim 13 in which said first flow-dividing member is provided with a handle projecting radially through an opening in said housing, said opening in said housing being circumferentially elongated to permit rotation of said first flow-dividing member over an arc of movement of approximately 180°.

* * * * *